US011168595B2

(12) United States Patent
Kondhare et al.

(10) Patent No.: US 11,168,595 B2
(45) Date of Patent: Nov. 9, 2021

(54) BREATHER FOR AN INTERNAL COMBUSTION ENGINE

(71) Applicant: Cummins Inc., Columbus, IN (US)

(72) Inventors: Amol Kondhare, Columbus, IN (US); David W. Ochs, Greenwood, IN (US); Vincil A. Varghese, McFarland, WI (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/737,034

(22) Filed: Jan. 8, 2020

(65) Prior Publication Data

US 2021/0207506 A1 Jul. 8, 2021

(51) Int. Cl.

| | |
|---|---|
| ***F02B 77/00*** | (2006.01) |
| ***F01M 13/04*** | (2006.01) |
| *F01M 13/00* | (2006.01) |

(52) U.S. Cl.

CPC . *F01M 13/0416* (2013.01); *F01M 2013/0038* (2013.01); *F01M 2013/0438* (2013.01); *F01M 2013/0488* (2013.01)

(58) Field of Classification Search

CPC .... F01M 13/04; F01M 13/0416; F01M 13/00; F01M 2013/0461

USPC ..... 123/195 C

See application file for complete search history.

(56) References Cited

U.S. PATENT DOCUMENTS

| | | | | |
|---|---|---|---|---|
| 5,285,754 | A * | 2/1994 | Bell | F01M 13/0416 123/195 C |
| 5,794,602 | A * | 8/1998 | Kimura | F01M 13/04 123/572 |
| 6,290,738 | B1 | 9/2001 | Holm | |
| 6,478,018 | B2 * | 11/2002 | Fedorowicz | F01M 13/0416 123/572 |
| 6,478,019 | B2 * | 11/2002 | Fedorowicz | F01M 13/0416 123/572 |
| 6,899,091 | B2 * | 5/2005 | Akiyama | F01M 13/04 123/572 |
| 7,096,847 | B1 * | 8/2006 | Nation | F01M 13/0416 123/198 E |
| 7,243,642 | B2 | 7/2007 | Nishikawa et al. | |
| D591,769 | S | 5/2009 | Chung | |
| 8,075,657 | B2 | 12/2011 | Ng et al. | |
| 8,701,622 | B2 * | 4/2014 | Sugiyama | F01M 13/022 123/196 CP |
| 9,010,365 | B2 | 4/2015 | Cella et al. | |
| D732,082 | S | 6/2015 | Porojan et al. | |
| 9,523,297 | B2 * | 12/2016 | Kitagawa | F01M 13/0416 |
| 9,534,521 | B1 | 1/2017 | MacCoon | |
| 9,737,835 | B2 | 8/2017 | Peck et al. | |
| 2004/0244783 | A1 | 12/2004 | Ookawa et al. | |
| 2007/0181107 | A1 * | 8/2007 | Shieh | F01M 13/04 123/572 |

(Continued)

*Primary Examiner* — Long T Tran
*Assistant Examiner* — James J Kim
(74) *Attorney, Agent, or Firm* — Taft Stettinius & Hollister LLP

(57) ABSTRACT

A breather is provided for an internal combustion engine that is configured to be mounted to provide a compact, space efficient packaging arrangement for the internal combustion engine. The breather includes a housing with a front wall, a rear wall opposite the front wall, and a plurality of sidewalls connecting the front and rear walls. The front wall is configured for attachment to the rearward end of the valve cover.

20 Claims, 8 Drawing Sheets

(56) References Cited

U.S. PATENT DOCUMENTS

| | | | | |
|---|---|---|---|---|
| 2013/0125865 | A1* | 5/2013 | Kobayashi | F01M 13/0416 123/573 |
| 2013/0298885 | A1* | 11/2013 | Efta | F01M 13/0011 123/574 |
| 2014/0290634 | A1* | 10/2014 | Slaughter | F01M 13/0416 123/573 |
| 2016/0194988 | A1* | 7/2016 | Lawrence | F01M 13/0416 123/573 |
| 2018/0306075 | A1* | 10/2018 | Osada | F01M 13/04 |
| 2020/0116055 | A1* | 4/2020 | Chu | F01M 13/022 |

* cited by examiner

BREATHER FOR AN INTERNAL COMBUSTION ENGINE

FIELD OF THE INVENTION

This invention relates to a breather for an internal combustion engine, and more particularly to an arrangement of the breather on a valve cover of the internal combustion engine.

BACKGROUND

Breathers are provided on internal combustion engines to separate oil from the crankcase blow-by gases. Current breather arrangements on the internal combustion engine suffer from various drawbacks with regard to location, size, and performance. Furthermore, engine packaging requirements may require engine configurations which further exacerbate these issues. Therefore, further improvements in breathers for internal combustion engines are needed.

SUMMARY

Embodiments include an internal combustion engine including at least one valve cover and a breather mounted on an end of the valve cover. In one embodiment, the end of the valve cover to which the breather is mounted is oriented toward the rearward end of the engine, i.e. towards the flywheel housing. The breather is arranged to extend vertically on the rearward end of the valve cover, which saves space on top of the engine which may be used for other components.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
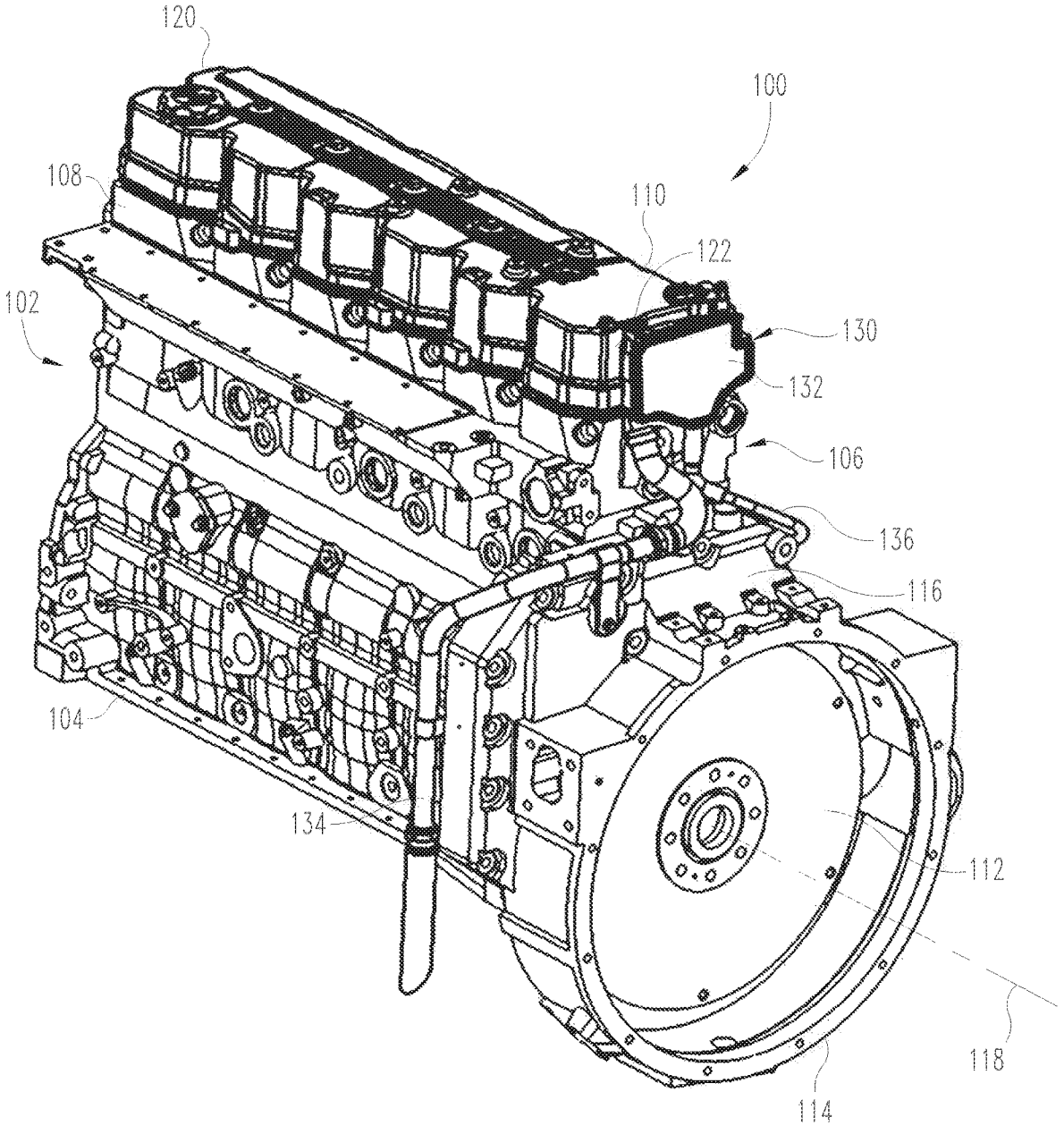
FIG. 1 is a perspective view of an internal combustion engine and a breather.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 2:
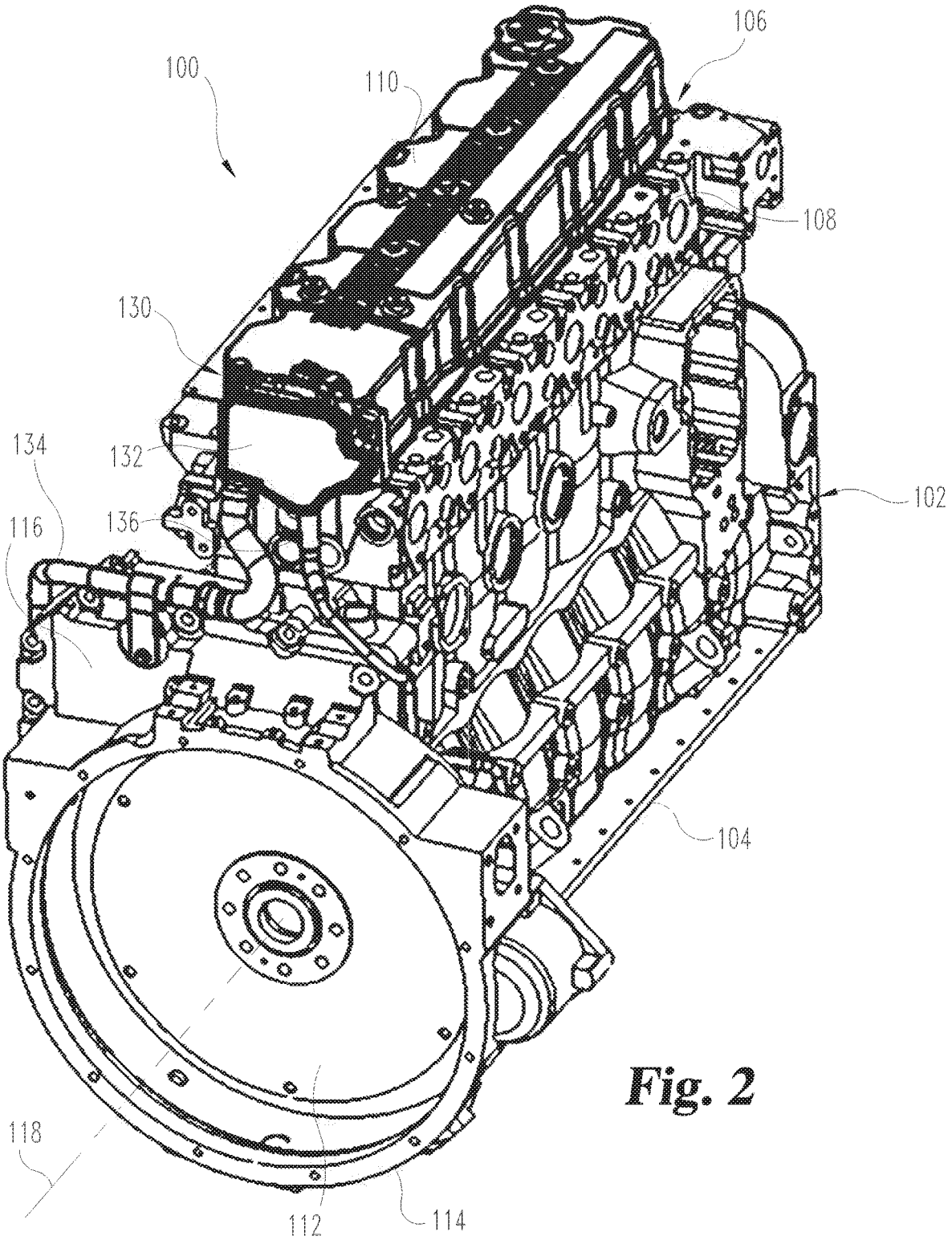
FIG. 2 is another perspective view of the internal combustion engine and the breather of FIG. 1.

Referring to FIG. 1-2, a system 100 is shown that includes an internal combustion engine 102 with a block 104 housing a plurality of components such as a crankshaft, a crankcase, and a plurality of cylinders associated with the cylinder bank 106. Internal combustion engine 102 extends along and defines a longitudinal axis 118 that is, or is parallel to, a rotational axis of flywheel 112 and/or the rotational axis of the crankshaft. Flywheel 112 is located in a flywheel housing 114 on a rearward end 116 of the internal combustion engine 102. Internal combustion engine 102 further includes a cylinder head 108 and a valve cover 110 on cylinder head 108. A breather 130 is mounted to valve cover 110. Other components are also contemplated but not illustrated, such as pistons, gears, pumps, housings, turbines, etc. that would normally be found on an internal combustion engine. The internal combustion engine 102 may be any type of internal combustion engine that requires a breather, including at least a diesel, gasoline, or natural gas engine, and/or combinations thereof.

Figure 3:
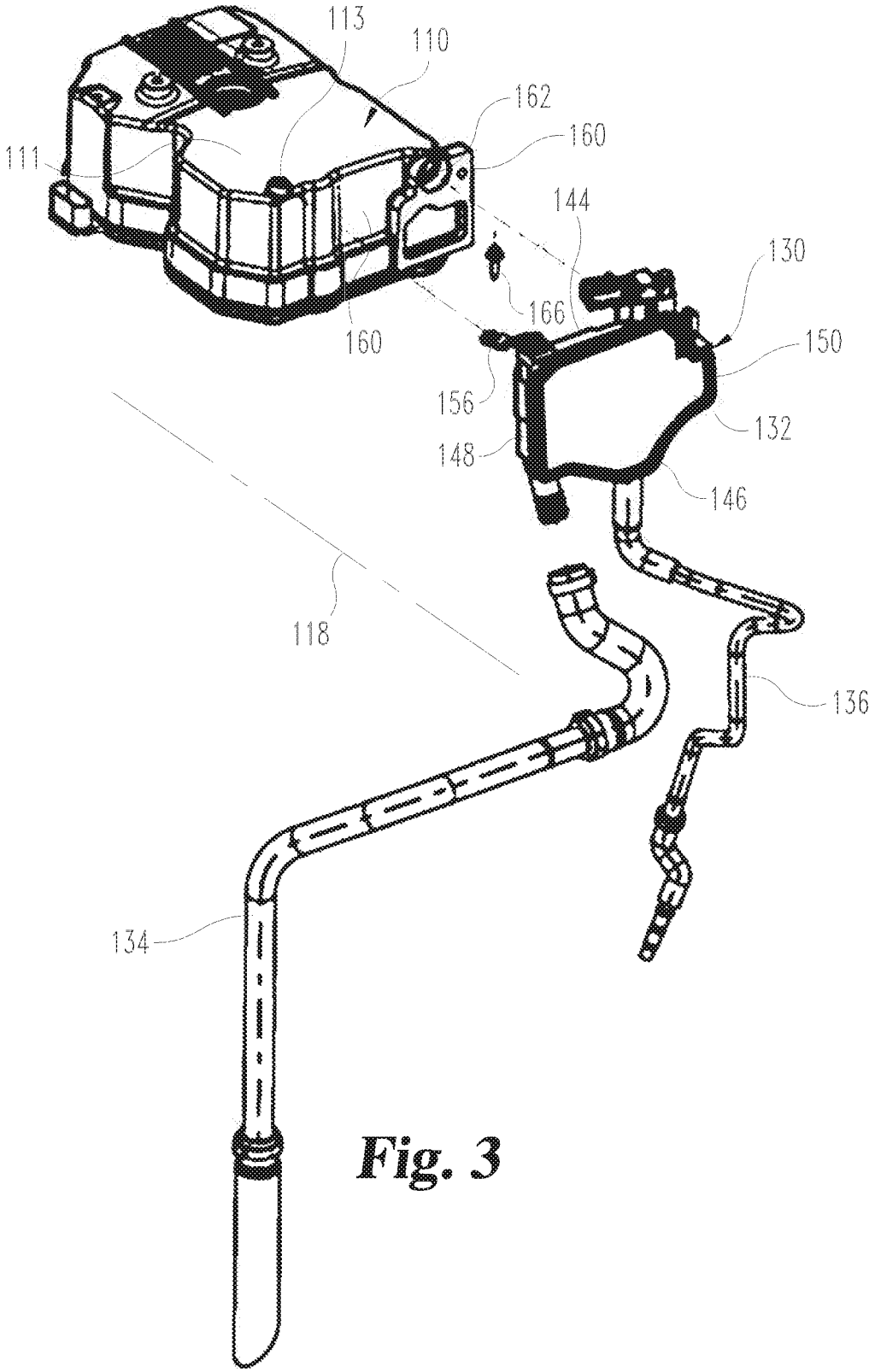
FIG. 3 is an exploded perspective view of the breather and part of a valve cover of the internal combustion engine of FIG. 1.

Referring further to FIG. 3, the valve cover 110 extends along longitudinal axis 118 from a forward end 120 to a rearward end 122 that is oriented toward flywheel 112. Sides 124, 26 of valve cover 110 extend along axis 118 between the forward and rearward ends 120, 122 of valve cover 110. Breather 130 includes a housing 132 that is mounted to rearward end 122 of valve cover 110. Breather 130 includes a blow by vent tube 134 extending downward from housing 132 along block 104 to atmosphere. Breather 130 also includes a drain tube 136 extending from a bottom of housing 132 for connection to the crankcase to drain any lubrication fluid that might be collected in housing 132.

Figure 4:
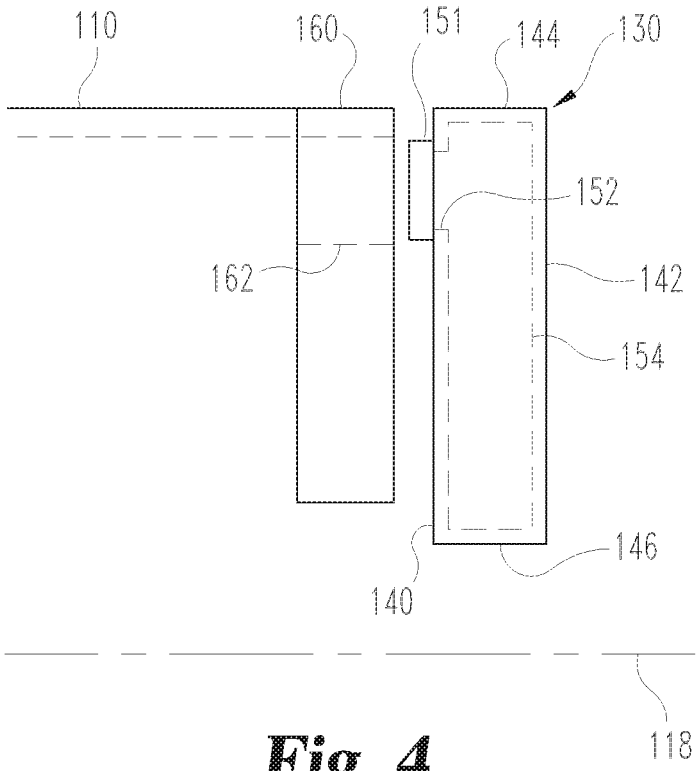
FIG. 4 is a schematic depiction of a side view of a connection between the breather and the valve cover.
Figure 5:
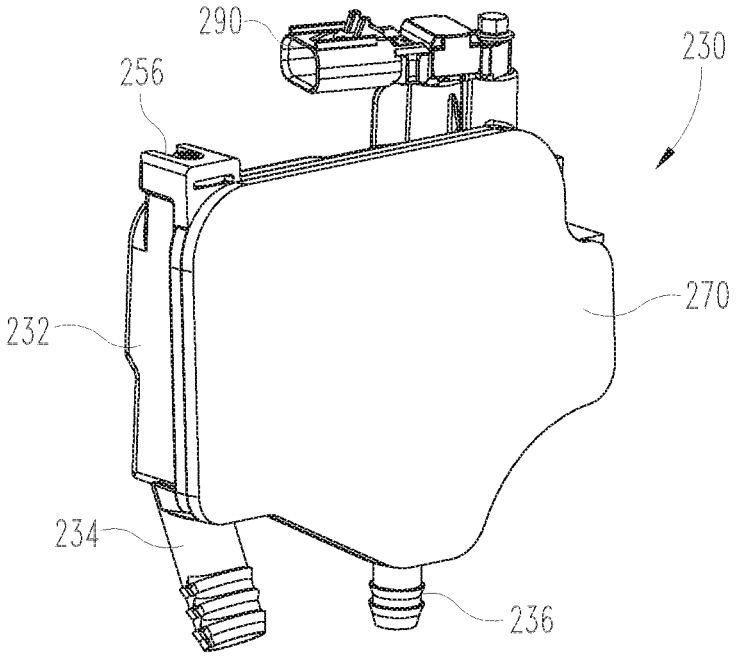
FIG. 5 is a perspective view of a breather according an embodiment of the present disclosure, looking toward the rear side of the breather.
Figure 6:
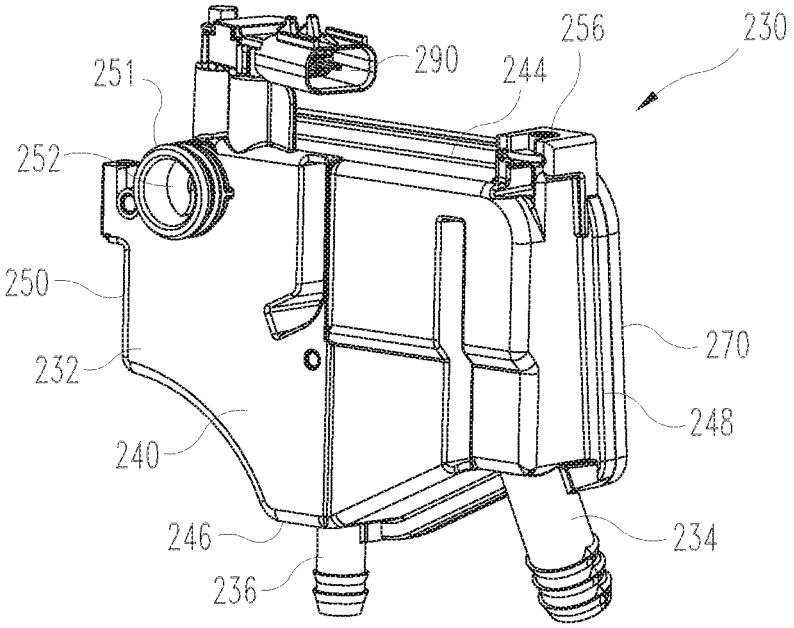
FIG. 6 is a perspective view of the breather of FIG. 5 looking toward a front side of the breather, which is configured to mate with the valve cover of FIGS. 1-3.
Figure 7:
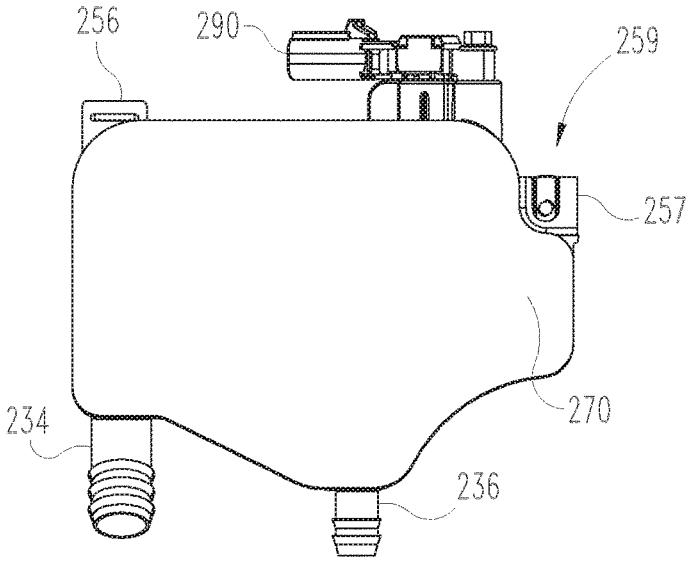
FIG. 7 is an elevation view of the rear side of the breather of FIG. 5.
Figure 9:
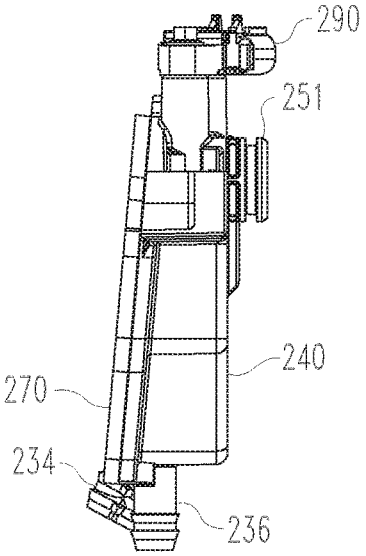
FIG. 9 is a right side elevation view of the breather of FIG. 5.
Figure 10:
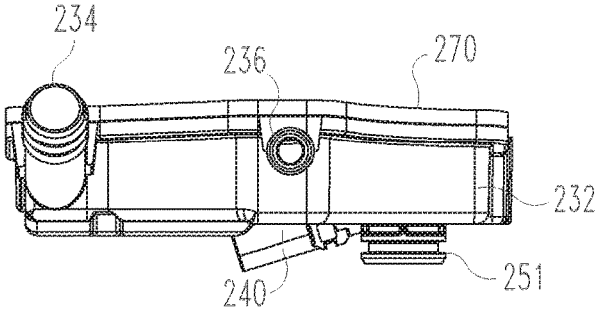
FIG. 10 is a bottom elevation view of the breather of FIG. 5.
Figure 8:
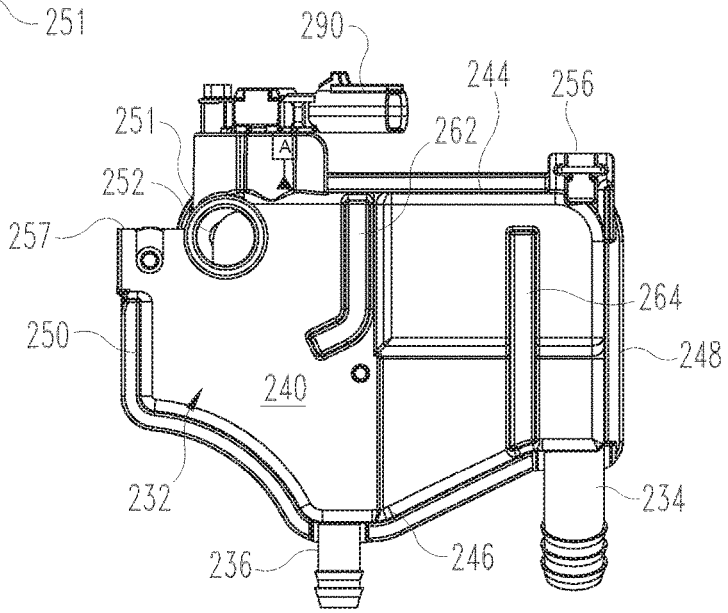
FIG. 8 is an elevation view of the front side of the breather of FIG. 5.
Figure 11:
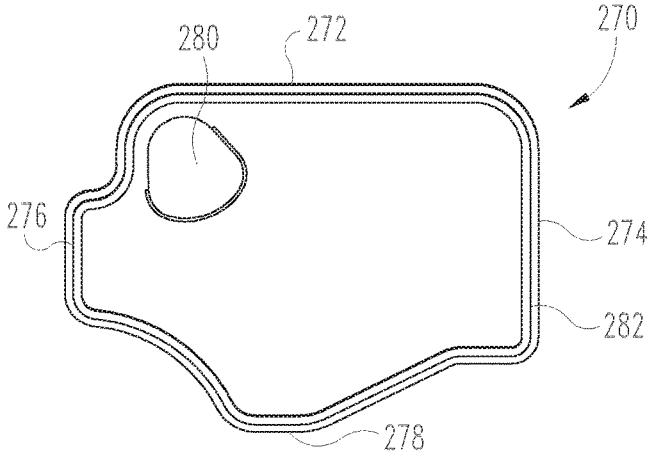
FIG. 11 is an elevation view of a front, inner side of a rear breather cover of the breather of FIG. 5.
Figure 13:
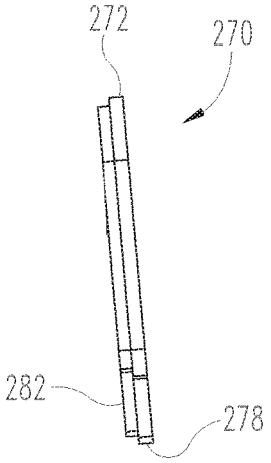
FIG. 13 is a right side elevation view of the breather cover of FIG. 11.
Figure 14:
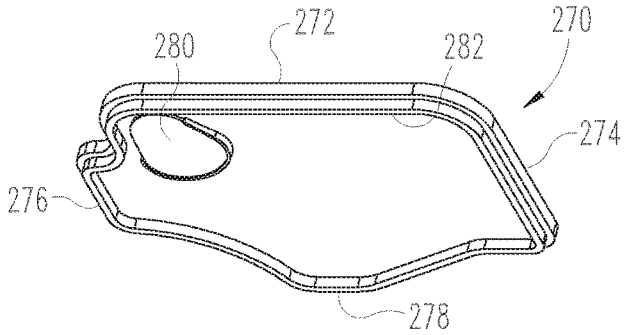
FIG. 14 is a perspective view looking toward the front, inner side of the rear breather cover of FIG. 11.
Figure 12:
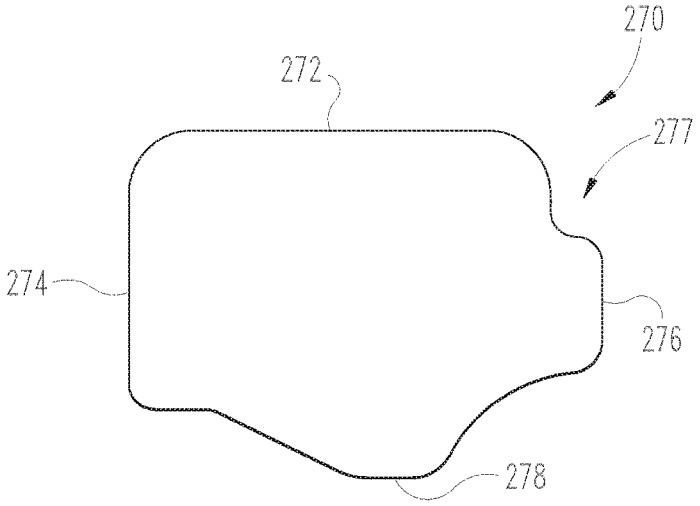
FIG. 12 is an elevation view of a rear side of the breather cover of FIG. 11.
Figure 17:
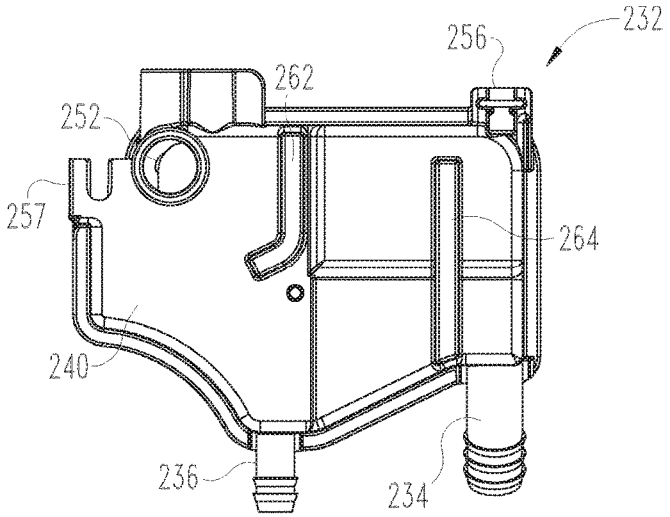
FIG. 17 is an elevation view of the front side of the housing of FIG. 15.
Figure 18:
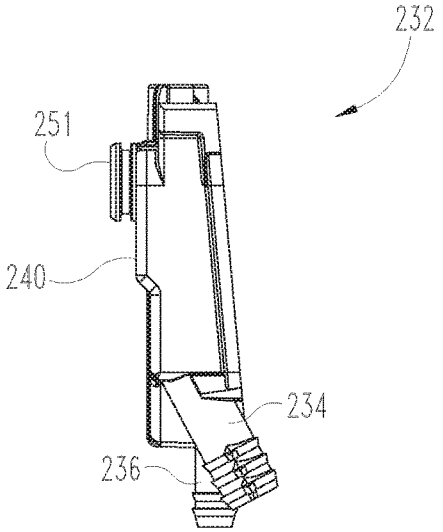
FIG. 18 is an elevation view of the right side of the housing of FIG. 17.
Figure 15:
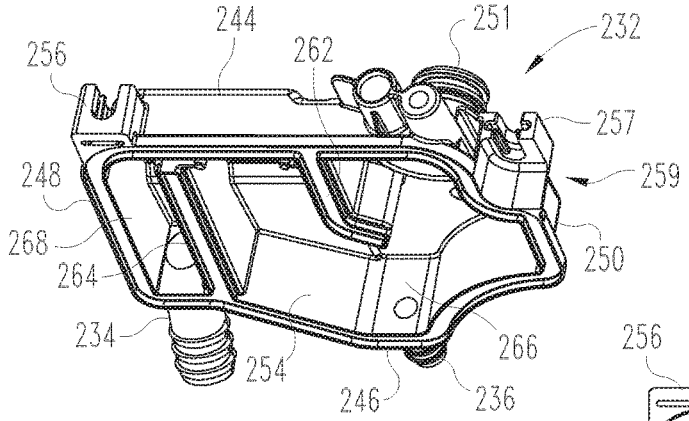
FIG. 15 is a perspective view looking toward the rear side of the housing of the breather of FIG. 5 with the breather cover removed.
Figure 16:
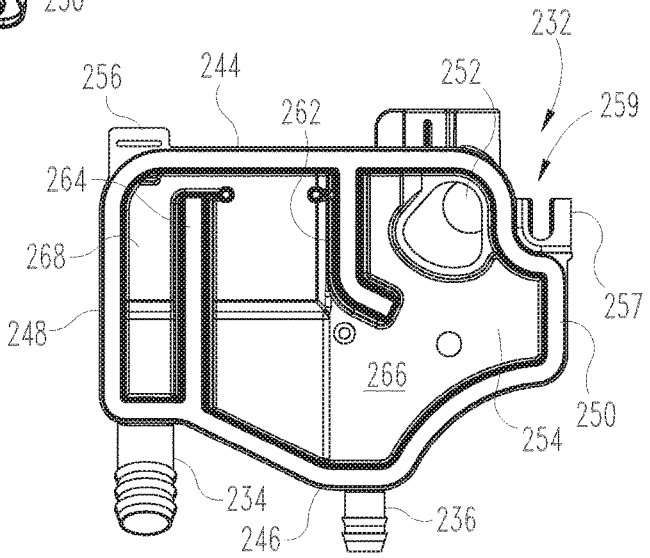
FIG. 16 is an elevation view of the rear side of the housing of FIG. 15.

Housing 132 include a front wall 140, a rear wall 142, and a plurality of sidewalls connecting front and rear walls 140, 142. In the illustrated embodiment, there is a top sidewall 144, a bottom sidewall 146, and lateral sidewalls 148, 150. In one embodiment, rear wall 142 is provided by a removable cover. Referring further to FIG. 4, in its mounted arrangement with breather 130 on valve cover housing 110, the front and rear walls 140, 142 of housing 132 are vertically oriented and extend both vertically and laterally in an orthogonal relationship to longitudinal axis 118. The sidewalls of housing 132 extend between front and rear walls 140, 142 in a direction that parallels longitudinal axis 118.

Valve cover 110 includes a mounting flange 160 that projects outwardly from rearward end 122. Rearward end 122 of valve cover 110 also defines an opening 162 through flange 160 that allows fluid flow into and is in fluid communication with an interior of valve cover 110. The front wall 140 of housing 142 defines a passage 152 through a collar 151 that is sized and shaped to mate with opening 162 of valve cover 110 and provide fluid communication with an interior 154 of housing 132. The front wall 140 is secure against the mounting flange 160.

In the illustrated embodiment, the front and rear walls 140, 142 of housing 132 are at least two times larger in height and width than the depth of the sidewalls. In another embodiment the front and rear walls 140, 142 are at least fourth times larger in height and width than the depth of the sidewalls. Housing 132 therefore may include a general box shaped structure, although the bottom sidewall 146 may be curved downwardly as shown to accommodate a sump formed in housing 132 for the collection of fluid.

The breather 130 also includes at least one mounting tab 156 extending from top sidewall 144. Mounting tab 156 can include a connector that extends over a top surface 111 of valve cover 110 and is secured to mounting hole 113 of valve cover 110 with a fastener 166. Other embodiments contemplate one or more additional mounting tabs extending from housing 132 for connection to valve cover 110 or other component with one or more fasteners and/or connectors.

One embodiment of breather 130 is shown in FIGS. 5-10 and designated as breather 230. A breather cover 270 is shown in FIGS. 11-14, and a breather housing 232 is shown in FIGS. 15-18 with the breather cover 270 removed. Breather 230 includes a blow by vent tube connector 234 extending downward from housing 232 for connecting a vent tube, such as vent tube 134. Breather 230 also includes a drain tube connector 236 for connecting a drain tube, such as drain tube 136. Breather 230 includes a connector 290 that is in communication with the interior of breather 230 and is configured for connection to a sensor, such as crankcase pressure sensor (not shown.)

The breather 230 also includes at least one mounting tab 256 extending from a top sidewall 244 of housing 232. Mounting tab 256 is configured to receive and be engaged to a connector that is engaged to and extends from mounting tab 256 over a top surface 111 of valve cover 110. The connector can be secured to mounting hole 113 with a fastener 166 such as discussed above. Breather 230 also includes a second mounting tab 257 located in corner cutout 259 of housing 232 to receive another fastener (not shown) for securement of housing 232 to a rear side of valve cover 110. Other embodiments contemplate one or more additional mounting tabs extending from housing 132 for connection to valve cover 110 or other component.

Breather cover 270 is mounted to a rear side of housing 232. As shown in FIGS. 11-14, breather cover 270 includes a top wall 272, a first side wall 274, a second side wall 276, and a bottom wall 278. Second side wall 276 includes a corner cutout 277 that aligns with cutout 259 of housing 232. The outer perimeter of breather cover 270 can be configured to correspond in shape with, and be slightly larger than, the outer perimeter of housing 232. An inner or front facing side of breather cover 270 includes a compartment 280 that aligns with the valve cover opening 162 and holds a filtering media (not shown.) A lip 282 is spaced inwardly from the outer perimeter of breather cover 270 and is configured to allow the cover to be fit onto the rear side of housing 232, such as via one or more of a snap fit, friction fit, and fasteners.

Housing 232 include a front wall 240 and a plurality of sidewalls extending rearwardly from front wall 240 that are configured to engage breather cover 270. In the illustrated embodiment, there is a top sidewall 244, a bottom sidewall 246, and lateral sidewalls 248, 250. Front wall 240 includes a collar 251 that defines a passage 252 and is sized and shaped to mate with opening 162 of valve cover 110 to allow flow into interior 254 of housing 232. Interior 254 includes first and second baffles 262, 264 extending therein rearwardly from front wall 240 to separate the oil chamber 266 from the blowby chamber 268.

Various aspects of the present disclosure are contemplated as indicated in the claims appended hereto. According one aspect, a system includes an internal combustion engine and a breather.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a cylinder head and a valve cover with opposite sides extending along the cylinder head between a rearward-facing end and an opposite forward-facing end of the valve cover, wherein a top of the valve cover extends between the opposite sides and between the rearward-facing end and the forward-facing end of the valve cover; and a breather mounted on the rearward-facing end of the valve cover oriented toward a rearward-facing end of the engine, wherein the opposite sides of the valve cover extend along an axis that is parallel to a rotational axis of a flywheel mounted at the rearward-facing end of the engine, wherein the breather includes a blow by vent tube and an oil drain tube that extend from a bottom side of the breather oriented toward the flywheel.

2. The system of claim 1, wherein the rearward-facing end of the valve cover extends downwardly from the top of the valve cover.

3. The system of claim 2, wherein the valve cover is elongated between the forward-facing end and the rearward-facing end along an axis that parallels a rotational axis of the flywheel.

4. The system of claim 1, wherein the breather includes a housing having a front wall that includes a collar defining an opening that is sized to mate with another opening at the rearward-facing end of the valve cover with the internal combustion engine in fluid communication with an interior of the breather to receive flow from the internal combustion engine, the interior of the breather including an oil chamber and a blow by chamber that are separated from one another by first and second baffles extending rearwardly from the front wall into the interior, and wherein the blow by vent tube is connected to the blow by chamber and the oil drain tube is connected to the oil chamber.

5. The system of claim 1, wherein the valve cover includes a mounting flange protruding from said rearward-facing end and said breather is engaged against said mounting flange.

6. The system of claim 5, wherein the valve cover includes an opening that extends through the mounting flange that is in fluid communication with an interior of the breather.

7. The system of claim 1, wherein the breather includes a front wall, a rear wall opposite the front wall, and a plurality of sidewalls connecting the front wall and rear wall, wherein the front wall faces the rearward-facing end of the valve cover.

8. The system of claim 7, wherein the plurality of sidewalls includes at least two lateral sidewalls, an upper sidewall, and a lower sidewall, and the breather includes at least one mounting tab extending from the upper sidewall that is engaged to the valve cover with a fastener.

9. The system of claim 7, wherein the front wall and the rear wall of the breather are oriented vertically and horizontally, and orthogonally oriented to an axis that parallels a rotational axis of the flywheel of the internal combustion engine.

10. The system of claim 7, wherein the plurality of sidewalls parallel the rotational axis of the flywheel.

11. The system of claim 7, wherein the rear wall is formed by a removable cover.

12. The system of claim 1, wherein the breather is connected to a blow by vent tube connector and an oil drain tube connector.

13. An apparatus, comprising:

a breather for an internal combustion engine, wherein the breather includes a housing defining an interior, and the housing includes a front wall and a rear wall opposite the front wall, a plurality of sidewalls extending between and connecting the front wall and the rear wall, and the front wall is configured for attachment to a rearward-facing end of a valve cover of the internal combustion engine, wherein the front wall of the housing includes an opening defined by a collar that is sized to mate with another opening at the rearward-facing end of the valve cover, the housing defining an interior in fluid communication with the opening to receive flow from the internal combustion engine, the interior including an oil chamber and a blow by chamber that are separated from one another by first and second baffles extending rearwardly from the front wall into the interior.

14. The apparatus of claim 13, wherein the plurality of sidewalls include an upper sidewall and a lower sidewall, and the breather includes at least one mounting tab extending from the upper sidewall of the housing that is engageable to the valve cover.

15. The apparatus of claim 13, wherein the front wall and the rear wall of the housing are oriented vertically and horizontally, wherein the rearward-facing end of the valve cover extends downwardly from a top of the valve cover, and the front and rear walls of the housing are orthogonally oriented to an axis that parallels a rotational axis of the flywheel of the internal combustion engine.

16. The apparatus of claim 15, wherein the plurality of sidewalls parallel the rotational axis of the flywheel.

17. The apparatus of claim 15, wherein the front wall and the rear wall define a height and a width of the housing, and the plurality of sidewalls define a depth of the housing along the rotational axis.

18. The apparatus of claim 17, wherein the height and the width are at least twice as large as the depth.

19. The apparatus of claim 13, wherein the breather includes a blow by vent tube and an oil drain tube that extend from a bottom side of the breather, wherein the blow by vent tube is connected to the blow by chamber and the oil drain tube is connected to the oil chamber.

20. The apparatus of claim 19, wherein the breather is connected to a blow by vent tube connector and an oil drain tube connector.

* * * * *